US007552994B2

(12) United States Patent
Hsu

(10) Patent No.: US 7,552,994 B2
(45) Date of Patent: Jun. 30, 2009

(54) PRINT-HEAD MAINTENANCE DEVICE FOR USE IN AN INKJET PRINTER

(75) Inventor: Huai-Wen Hsu, Taipei (TW)

(73) Assignee: Qisda Corporation, Taoyuan County (TW)

( * ) Notice: Subject to any disclaimer, the term of this patent is extended or adjusted under 35 U.S.C. 154(b) by 360 days.

(21) Appl. No.: 11/359,724

(22) Filed: Feb. 22, 2006

(65) Prior Publication Data

US 2006/0197798 A1 Sep. 7, 2006

(30) Foreign Application Priority Data

Mar. 3, 2005 (TW) ..... 94106376 A

(51) Int. Cl.
*B41J 2/165* (2006.01)

(52) U.S. Cl. ..... 347/32; 347/29; 347/33

(58) Field of Classification Search ..... 347/29, 347/32, 33

See application file for complete search history.

(56) References Cited

U.S. PATENT DOCUMENTS

| | | | | |
|---|---|---|---|---|
| 2001/0043251 | A1* | 11/2001 | Beachnau Hood et al. | 347/33 |
| 2002/0130919 | A1* | 9/2002 | Davis et al. | 347/29 |
| 2004/0174409 | A1* | 9/2004 | Park et al. | 347/32 |
| 2004/0212656 | A1* | 10/2004 | Waller et al. | 347/33 |

FOREIGN PATENT DOCUMENTS

| | | |
|---|---|---|
| CN | 1446692 | 10/2003 |
| CN | 1486250 | 3/2004 |
| CN | 1803456 | 1/2005 |

OTHER PUBLICATIONS

Patent Abstracts of China and Computer English Translation of CN 1803456 dated Jan. 14, 2005.
Patent Abstracts of China and Computer English Translation of CN 1486250 dated Mar. 31, 2004.
Patent Abstracts of China and Computer English Translation of CN 1446692 dated Oct. 8, 2003.

* cited by examiner

*Primary Examiner*—Julian D Huffman
*Assistant Examiner*—Jason S Uhlenhake

(57) ABSTRACT

A maintenance device for shielding a print-head includes a casing having a first traveling path and a second traveling path transverse to the first traveling path, a sliding member disposed back and forth along the first traveling path; and a shielding unit including a seat movable back and forth along the second traveling path, and having two flanges for engaging a guiding track unit of the sliding member, and a shield fixed on the seat. Movement of the sliding member along the first traveling path in a first direction results in pushing of the seat by the sliding member, thereby moving the seat along the second traveling path so as to press the shield against the print-head. Movement of the sliding member along the first traveling path in a second direction results in removal of the shield from the print-head.

13 Claims, 6 Drawing Sheets

PRINT-HEAD MAINTENANCE DEVICE FOR USE IN AN INKJET PRINTER

FIELD OF THE INVENTION

The present invention relates to a maintenance device, more particularly to a print-head maintenance device for maintaining an inkjet printer. The maintenance device includes a shield movable up and downward in a vertical direction for abutting sealingly against the periphery of a print-head in the printer so as to prevent untimely vaporization of ink from the print-head.

BACKGROUND OF THE INVENTION

A conventional inkjet printer includes a print-head assembly having an ink cartridge formed with a print-head at a bottom end thereof, and a stepper motor for moving the ink cartridge back and forth across a sheet of paper so that when the print-head runs over the paper, an image is formed on the paper. When the printer is not in use, the print-head assembly is parked at the maintenance region (on one side of the printer), where the print-head assembly is kept under the maintenance condition for conducting another printing operation upon receipt of a command.

A conventional print-head maintenance device generally includes a wiper for peeling the waste ink off the print-head and a shield for sealingly pressing against the periphery of the print-head so as to prevent vaporization of the ink in the nozzles, thereby avoiding untimely and undesired blockage of the nozzles in the print-head.

Referring to FIG. 1, a conventional print-head maintenance device 1 is shown to include a casing 10, a wiper unit 11 and a shielding unit 12. The casing 10 is shaped as a rectangle, and includes two side plates that cooperatively define a pair of straight guiding grooves 102 and a pair of inclined guiding grooves 101 behind the straight guiding grooves 102 and that define a receiving space therebetween for receiving the wiper unit 11 and the shielding unit 12 therein. The shielding unit 12 includes a sliding member 121 having front and rear pairs of engaging tongues received slidably in the straight and inclined guiding grooves 102, 101, an upper contact portion 1211 projecting upwardly from the sliding member 121, and a spring-loaded shield 122 mounted on the sliding member 121. A tension spring 13 interconnects the sliding member 121 and the casing 10 under tension. The wiper unit 11 is seated on the sliding member 121 behind the shielding unit 12 (see FIG. 2A), and has two pivots extending rotatably into two pivot holes in the casing 10 and a wiper 111 projecting perpendicularly from the sliding member 121.

Referring to FIG. 2A, upon finishing a printing operation, the ink cartridge C moves toward the maintenance region in the X direction (i.e. toward the left side of the printer), in which the print-head C1 make contact with the wiper t111, thereby removing the waste ink from the print-head C1.

Referring to FIG. 2B, as the ink cartridge C moves further (after the print-head C1 make contact with the wiper 111) for a distance of "D" in the X direction, collision of the cartridge C against the contact portion 1211 of the sliding member 121 results in vertical movement of the latter with respect to the casing 10, thereby raising the shielding 122 upward so as to press sealingly against the periphery of the print-head C1. Under this condition, the ink within the nozzles (not visible) of the print-head C1 is prevented from vaporization and blocking.

Note that the shield 122 contacts the print-head C1 in a sidewise manner since the sliding member 121 is raised gradually upward as it travels along the straight and inclined guiding grooves 102, 101 in the casing 10, thereby causing sidewise wearing of the shield 122. The sidewise wearing may decrease the hermetically sealing effect of the shield 122 with respect to the print-head C1, which, in turn, results in untimely drying of the ink in the print-head C1. It is noted that in the inkjet printer of nowadays, an air pump (not visible in the drawing) is generally installed in the print-head assembly in order to pump out the waste ink when the print-head assembly is parked at the maintenance region. Once the sidewise wearing is occurred, the pumping effect is accordingly reduced, i.e. the air pump is unable to pump out the waste ink effectively from the print-head.

Moreover, the casing 10 must reserve a distance of "D" (see FIG. 2B) in order to permit movement of the ink cartridge C into the maintenance region, during which the cartridge C make contact with the contact portion 1211 of the sliding member so as to result in movement of the latter in the casing 10. Under such arrangement, the maintenance region in the casing 10 is increased, which, in turn, causes increase in the overall length of the conventional inkjet printer. Since the manufacturers of the printers are in the trend to produce the printer in a compact design, a new design for the print-head maintenance device is badly in need to eliminate the drawbacks encountered during use of the conventional inkjet printer.

SUMMARY OF THE INVENTION

The object of the present invention is to provide a print-head maintenance device for use in an inkjet printer. The maintenance device includes a shield movable up and downward in a vertical direction for abutting sealingly against the periphery of a print-head in the printer so as to prevent untimely vaporization of ink from the print-head.

In one aspect of the present invention, a print-head maintenance device is provided for use in an inkjet printer, wherein the inkjet printer includes an ink cartridge having a print-head. The print-head maintenance device includes: a casing defining a first traveling path extending parallel to a bottom of the casing and a second traveling path extending perpendicularly from the bottom of the casing; a sliding member disposed within the casing and movable back and forth along the first traveling path, the sliding member having a guiding track unit; and a shielding unit including a mounting seat disposed in the casing and movable back and forth along the second traveling path and having two flanges on two lateral sides thereof for engaging the guiding track unit of the sliding member, and a shield fixed on the mounting seat. Movement of the sliding member along the first traveling path in a first direction results in pushing of the mounting seat by the sliding member, thereby moving the mounting seat along the second traveling path so as to press the shield against the print-head. Movement of the sliding member along the first traveling path in a second direction opposite to the first direction results in removal of the shield from the print-head.

In a second aspect of the present invention, a print-head maintenance device is provided for shielding a print-head of an ink cartridge, the ink cartridge being movable back and forth along a guiding rail. The maintenance device is disposed securely below one end of the guiding rail and includes: a casing having a bottom, left and right sides formed with a pair of first guiding grooves extending parallel to the bottom of the casing, the casing further being formed with a pair of second guiding grooves that are located inwardly with respect to the pair of first guiding grooves and that extend perpendicularly from the bottom of the casing; a sliding member disposed within the casing and having left and right outward tongues engaging slidably the pair of first guiding grooves so as to permit two-way movement of the sliding member within the casing, the sliding member further having a pair of inclined third guiding grooves formed on two opposite inner surfaces thereof, and a shielding unit including a mounting seat disposed within the casing and having front and rear positioning stubs respectively engaging the pair of second guiding grooves in the casing, and two flanges on left and right lateral sides thereof for engaging with the pair of third guiding grooves in the sliding member, and a shield fixed on the mounting seat. Movement of the sliding member along the pair of first guiding grooves in a first direction results in pushing of the mounting seat by the sliding member, thereby moving the mounting seat along the pair of second guiding groove so as to press the shield against the print-head. Movement of the sliding member along the pair of first guiding grooves in a second direction opposite to the first direction results in removal of the shield from the print-head.

In a third aspect of the present invention, a maintenance device is provided for shielding two print-heads of a pair of ink cartridges that are juxtaposed to each other, the ink cartridges being movable back and forth along a guiding rail. The maintenance device is disposed securely below one end of the guiding rail and includes: a casing having a bottom, and left and right sides formed with a pair of first guiding grooves extending parallel to of the bottom, the casing further being formed with a pair of second guiding grooves that are located inwardly with respect to the pair of first guiding grooves and that extend perpendicularly from the bottom of the casing; a sliding member disposed within the casing and having left and right outward tongues engaging slidably the pair of first guiding grooves in the casing so as to permit two-way movement of the sliding member within the casing, the sliding member having a pair of inclined third guiding grooves and a pair of inclined fourth guiding grooves; a first shielding unit including a first mounting seat that has front and rear positioning stubs respectively engaging the pair of second guiding grooves in the casing, and two flanges at left and right lateral sides thereof for engaging the pair of inclined third guiding grooves in the sliding member, and a first shield fixed on the first mounting seat; and a second shielding unit including a second mounting seat that has front and rear positioning stubs respectively engaging the pair of second guiding grooves in the casing, and two flanges at left and right lateral sides thereof for engaging the pair of inclined fourth guiding grooves in the sliding member, and a second shield fixed on the second mounting seat. Movement of the sliding member along the pair of first guiding grooves in a first direction results in simultaneous pushing of the first and second mounting seats by the sliding member, thereby moving the first and second mounting seats along the pair second guiding grooves so as to press the first and second shields respectively against the print-heads. Movement of the sliding member along the pair of first guiding grooves in a second direction opposite to the first direction results in removal of the first and second shields respectively from the print-heads.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTIONS OF THE PREFERRED EMBODIMENT

Figure 1:
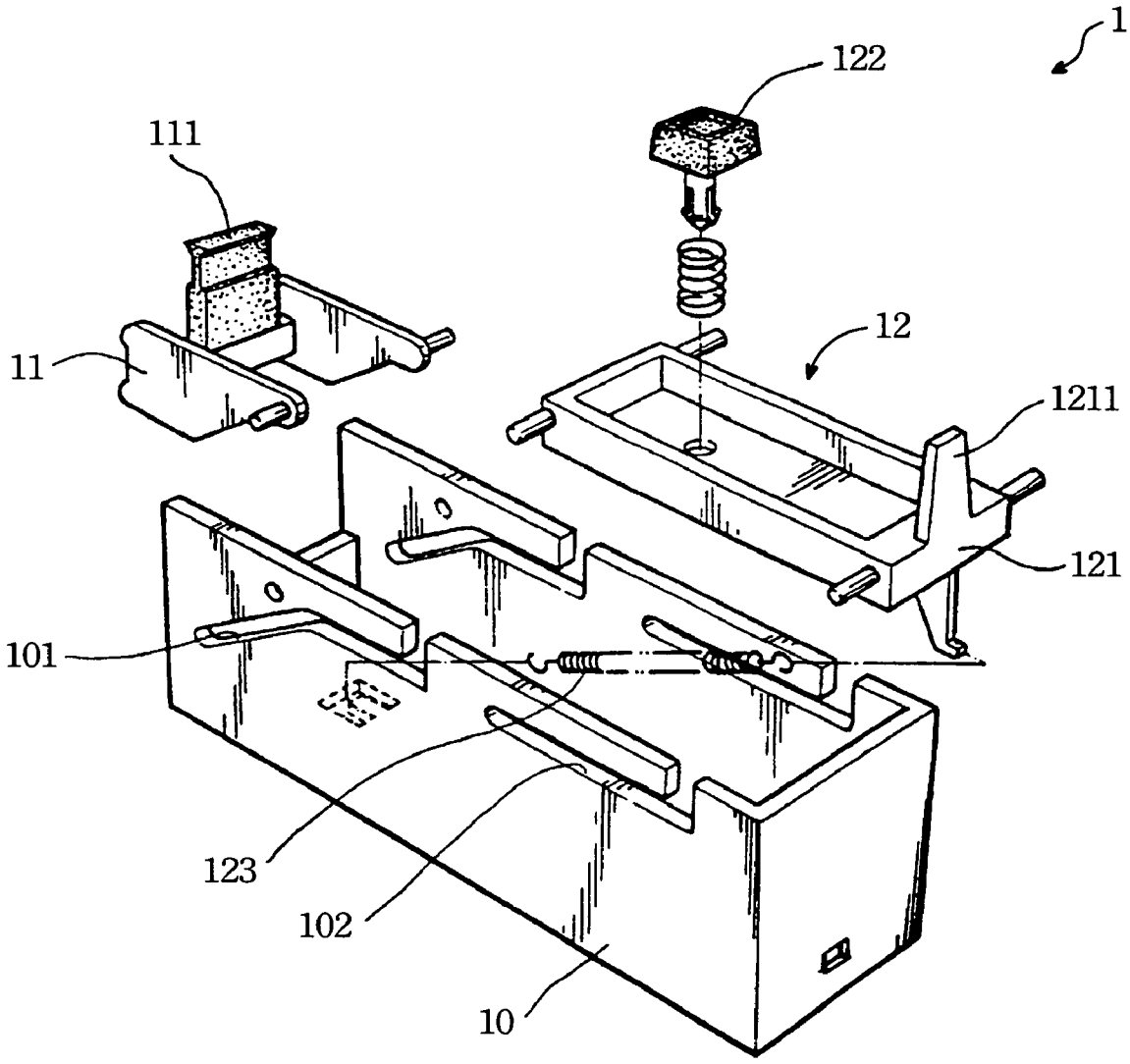
Fig. 1 (Prior Art)
FIG. 1 is an exploded and perspective view of a print-head maintenance device employed in a conventional inkjet printer.
Figure 2A:
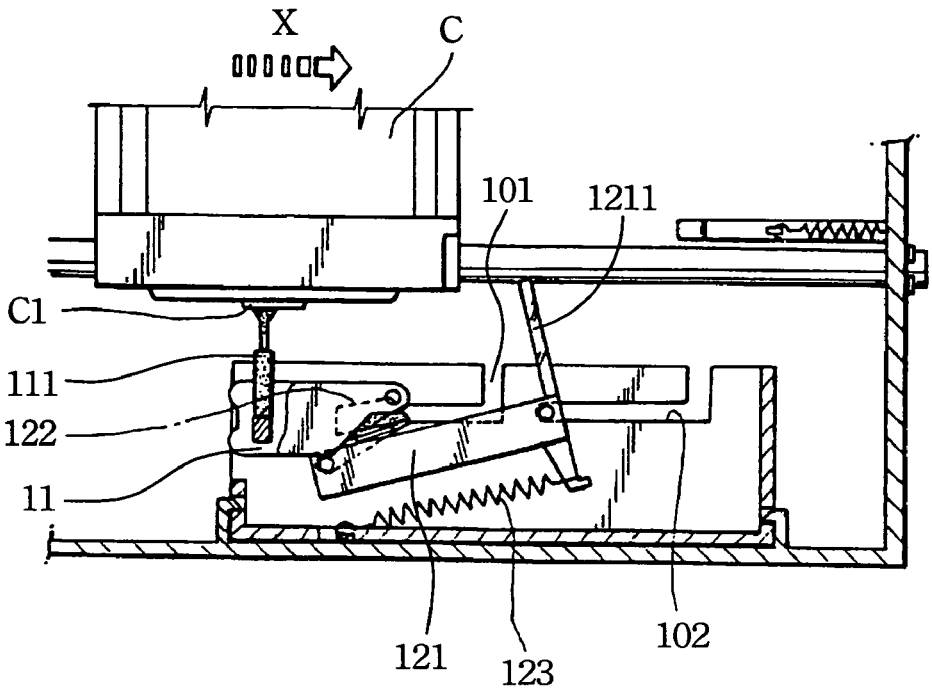
Fig. 2A (Prior Art)
FIGS. 2A and 2B respectively show how the waste ink on a print-head is wiped out and how the print-head is protected when the latter is parked in a maintenance region in the conventional inkjet printer.
Figure 2B:
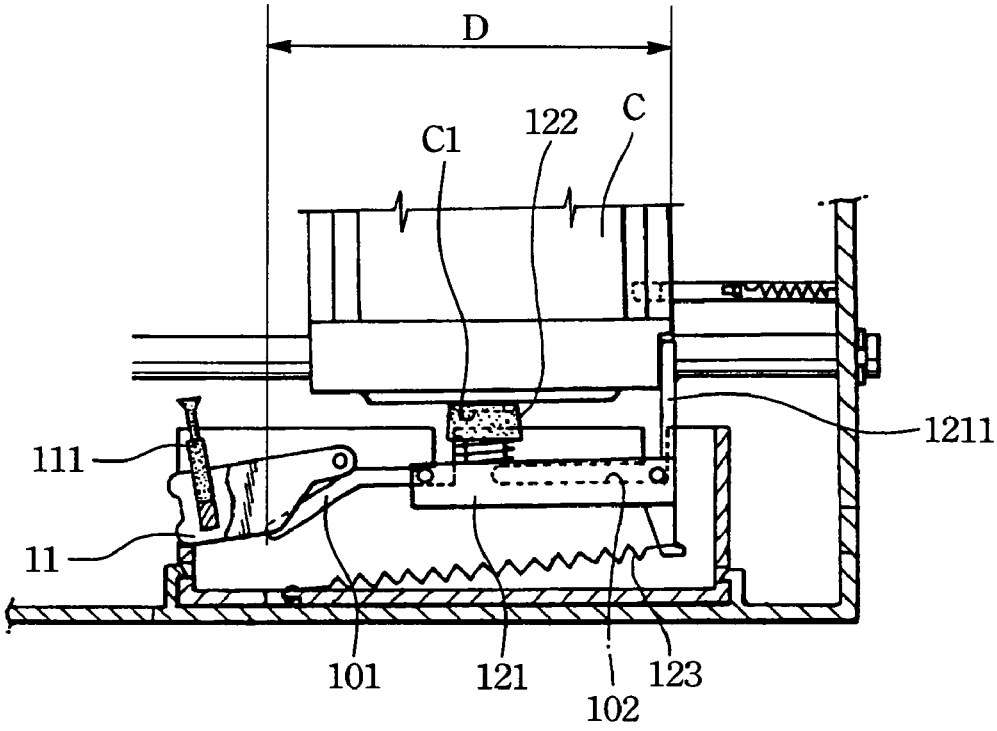
Fig. 2B (Prior Art)
Figure 3:
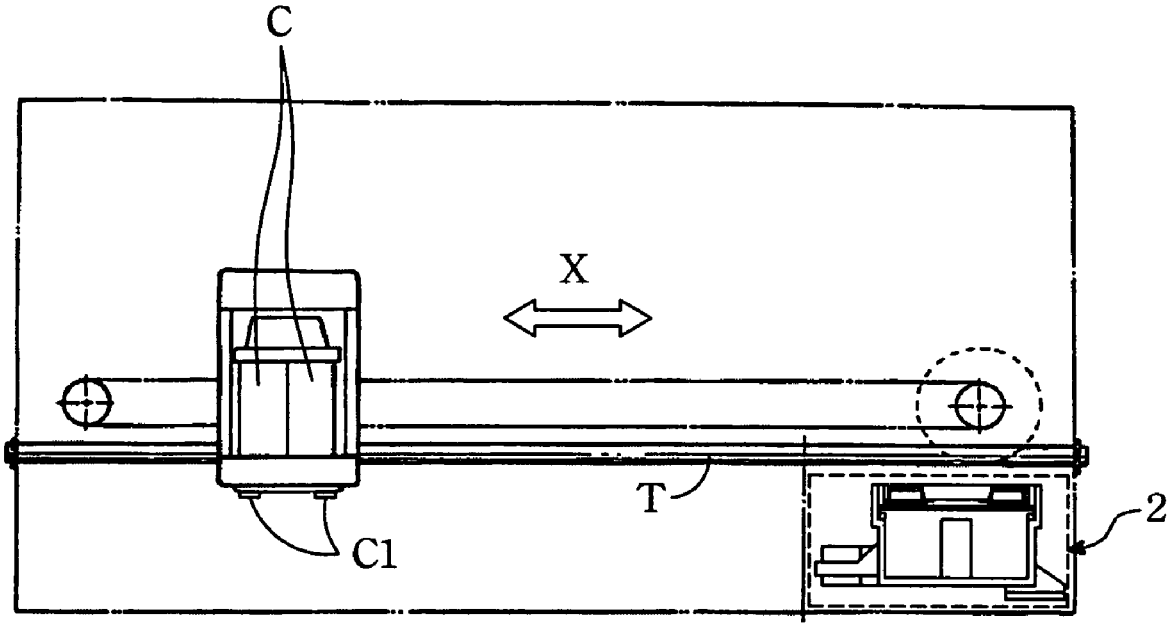
FIG. 3 is a side view of a print-head maintenance device of the present invention for employment in an inkjet printer.

Referring to FIG. 3, an inkjet printer is shown to include two ink cartridges C and a print-head maintenance device 2 of the present invention. The inkjet printer traditionally includes two ink cartridges, such as separate black and color cartridges or two color cartridges. In order to better understanding of the present invention, two juxtaposed ink cartridges C are used in the printer. The ink cartridges C move back and forth along a guiding rail T in the X direction so as to perform a printing operation across a paper, thereby forming image or letters on the paper (not shown). Each of the ink cartridges C has a print-head C1 at a lower portion thereof. Upon finishing the printing operation, the ink cartridges C are moved into and are latter parked at the maintenance region (shown by dotted circle at the right side of FIG. 3), in which, the print-heads C1 are protected by the maintenance device 2 of the present invention so as to prevent drying or blockage of the ink in the print-heads C1. As to how the ink cartridges C are driven by a driving member so as to be parked at the maintenance region of the printer is not the relevant feature of the present invention, a detailed disclosure of the same is omitted herein for the sake of brevity.

Figure 4A:
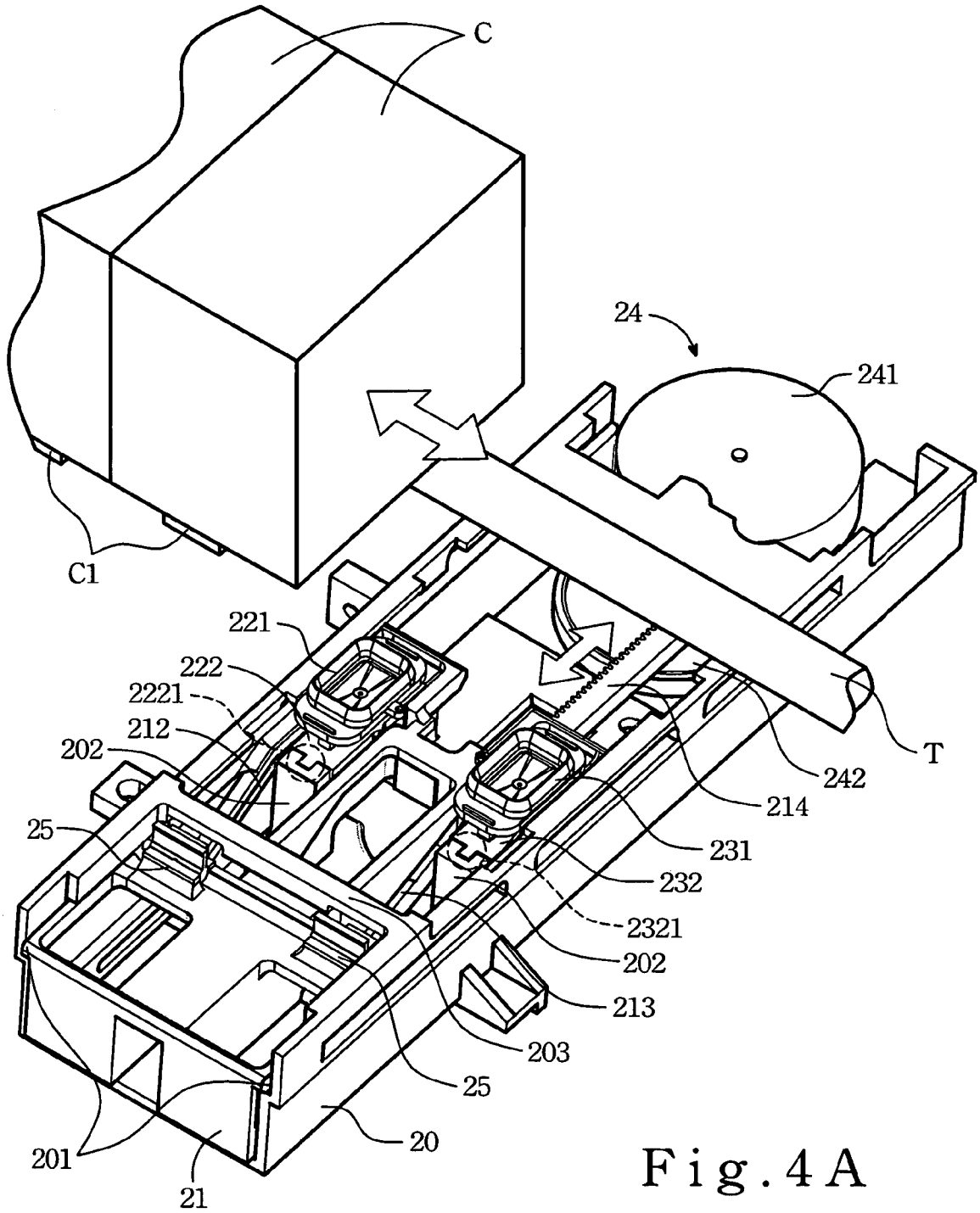
FIG. 4A is a fragmentary perspective view of the print-head maintenance device shown in FIG. 3.
Figure 4B:
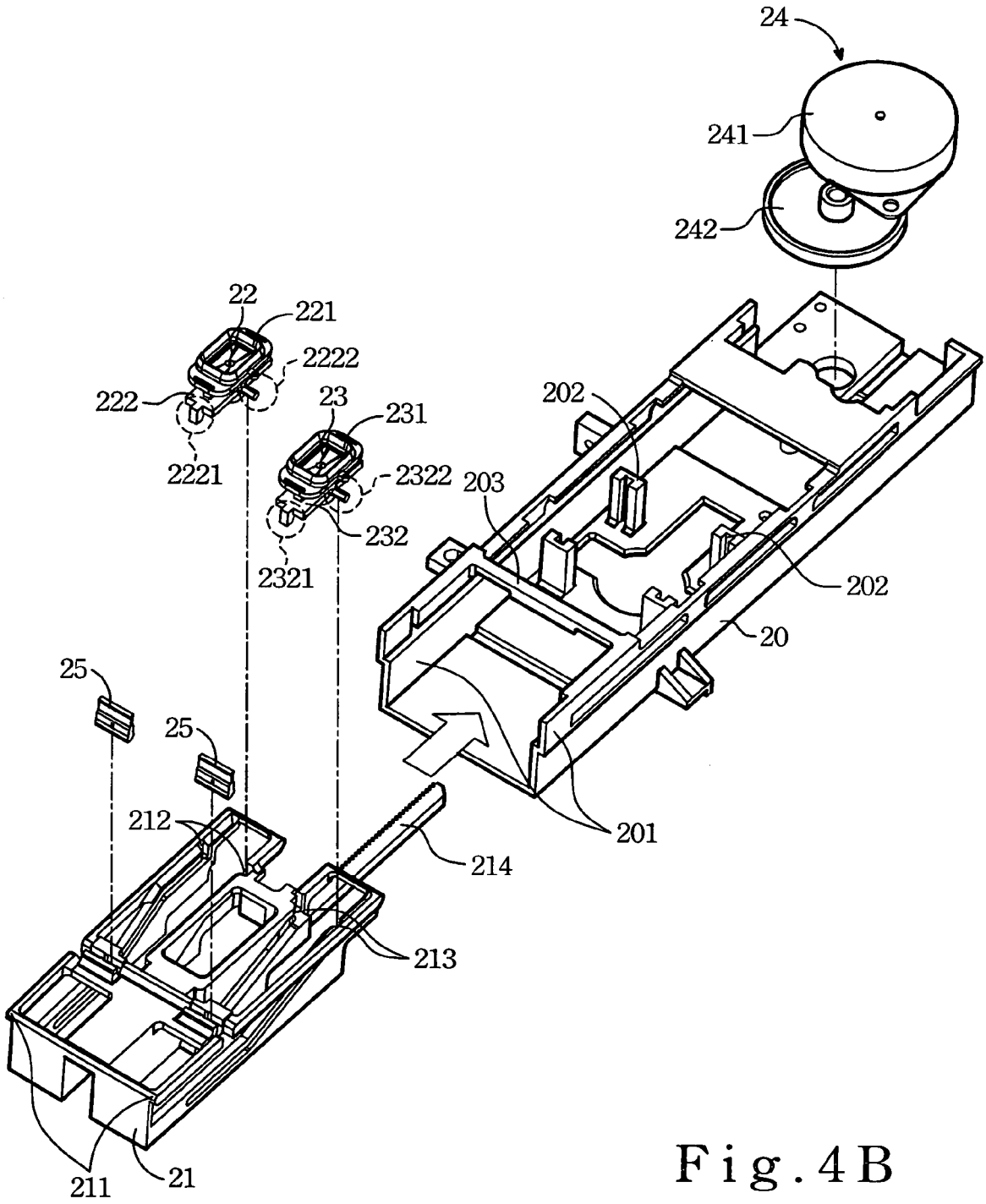
FIG. 4B is an exploded view of the print-head maintenance device of the present invention.

Referring to FIGS. 4A and 4B, the print-head maintenance device 2 of the present invention is disposed securely below one end of the guiding rail T, and includes a casing 20, a sliding member 21, a first shielding unit 22 and a second shielding unit 23.

As illustrated, the casing 20 is rectangular-shaped, has a bottom and left and sides 201 extending upwardly from the bottom to define a receiving space therebetween. The left and right sides 201 of the casing 20 are formed with a pair of first guiding grooves that extend parallel to the bottom and that define a first traveling path, and two pairs of second guiding grooves 202 that are located inwardly with respect to the pair of first guiding grooves, that extend perpendicularly from the bottom of the casing 20 and that cooperatively define a second traveling path. The first and second traveling paths may have different configurations, such as rails, rollers or track, so long as it permit an article to move back and forth therealong. In this embodiment, two pairs of posts extend perpendicularly from the bottom of the casing 20 to define the pair of second guiding grooves 202.

The sliding member 21 is generally rectangular in shape, is disposed within the casing 20, and has left and right outward tongues 211 engaging slidably the pair of first guiding grooves in the casing 20 so as to permit two-way movement of the sliding member 21 within the casing 20. The sliding member 21 has a guiding track unit consisting of a pair of inclined third guiding grooves 212 and a pair of inclined fourth guiding grooves 213.

Each of the first and second shielding units 22,23 includes a mounting seat 222, 232 that has front and rear positioning stubs 2221, 2321 respectively engaging the respective pair of second guiding grooves 202 in the casing 20, and two flanges 2222, 2322 on left and right lateral sides thereof for engaging the pairs of inclined third guiding grooves 212, 213 in the sliding member 21. Each of the first and second shielding units 22,23 further includes a shield 221, 231 fixed on the respective mounting seat 222, 232.

By virtue of the aforesaid arrangement, movement of the sliding member 21 along the pair of first guiding grooves in a first direction results in simultaneous pushing of the mounting seats 222,232 by the sliding member 21, thereby moving the mounting seats 222,232 along the pair of second guiding grooves 202 so as to press the shields 221,231 respectively and sealingly against the print-heads C1. Under this condition, the ink in the print-heads C1 is prevented from untimely vaporization (drying or blocking). In the same manner, movement of the sliding member 21 along the pair of first guiding grooves in a second direction opposite to the first direction results in removal of the shields 221,231 respectively from the print-heads C1.

Note that since the shields 221,231 are moved vertically upward so as to press sealingly against the print-heads C1, no sidewise wearing of the shields 221,231 is occurred, thereby providing a high hermetical sealing effect to the print-heads C1. Another important aspect to note is that in the present embodiment, the maintenance device 2 is vertically mounted in the printer, thereby reducing an overall dimension of the printer. In other embodiment (such as a printer having a single cartridge), the maintenance device 2 can be mounted horizontally in the printer. Such type of mounting system may slightly increase the longitudinal length of the printer.

Referring again to FIG. 4B, the print-head maintenance device 2 further includes a one-piece cleaning structure 203, two wipers 25, and a driving member 24 for moving the sliding member 21 along the pair first guiding grooves in the casing 20. The driving member 24 includes a stepper motor 241 and a gear system 242. The sliding member 21 has a rack 214 extending outwardly from one end thereof for engaging with the stepper motor 241 via the gear system 242 such that the stepper motor 241 possesses high torque for moving the sliding member 21. Under such arrangement, actuation of the stepper motor 241 results in movement of the sliding member 21 along the pair first guiding grooves in the casing 20. The wipers 25 are fixed on a top portion of the sliding member 21 in such a manner that when the sliding member 21 moves along the pair of first guiding grooves in the first direction so as to pass below the print-heads C1, the wipers 25 contact and subsequently clean the waste ink from the print-heads C1 respectively. The cleaning structure 203 is integrally formed with an upper portion of the casing 20, and extends upwardly from the casing 20. Since the cleaning structure 203 is disposed midway or transversely to the first guiding grooves, the same make contact with the wipers 25 by virtue of relative movement therebetween when the wipers 25 move together with the sliding member 21 along the pair of first guiding grooves in the first direction, thereby cleaning the waste ink from the wipers 25.

Another important aspect to note is that, each of the shields 221, 231 is mounted on the respective seat 222, 232 in such a manner to have fluid communication with an air pump (not shown). Once the respective shield presses sealingly against the respective print-head, the air pump can effectively pump out the waste ink from the print-head C1 by virtue of airtight abutment between the shield 221, 231 and the print-head C1.

Due to rapid advance in the printing technology and as the consumers demand a higher resolution of the printout images, some inkjet printers are provided with multiple ink cartridges to provide high resolution image. A four-color inkjet printer generally includes a black cartridge and a triple-color cartridge (i.e. cyan, magenta, yellow) such that the printout images will have better color effects, hence better resolution. In a six-color inkjet printer, two triple-color cartridges are used to print out high quality image. As a matter of fact, four-color inkjet printer is generally used to print out an image when the consumer does not require a high quality (such as common leaflet) in order to economize the expense, since the black cartridge releases larger droplets of ink to constitute a major portion of the entire color for formation of the image. In contrast, the six-color inkjet printer is used when it is required to print out photo-quality images (such as photo, magazines), since the triple-color cartridges release tiny drops of inks mixing evenly to form the photo-quality images. When the print-head maintenance device 2 of the present invention is utilized in the four-color inkjet printer and when the cartridges are moved into the maintenance region after completing the printing operation, the shields 221, 231 simultaneously abut against the print-heads of the cartridges. Activation of the air pumps can pump out the waste ink from the print-heads. However, the air pumps may get into ruin due to blockage by the larger droplets in the black cartridge employed in the four-color inkjet printer.

Figure 5A:
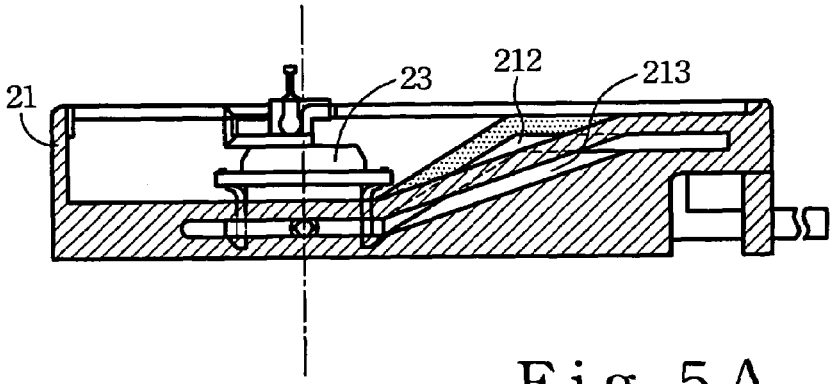
FIG. 5A is a sectional view of the print-head maintenance device of the present invention shown in FIG. 4A.

FIG. 5A illustrates a sectional view of the print-head maintenance device 2 shown in FIGS. 4A and 4B, wherein the third and four inclined guiding grooves 212, 213 in the sliding member 21 are constructed in such a manner to have different inclination. When the shielding units 22, 23 are at the initial position, the shields 221, 231 are flush with each other.

Figure 5B:
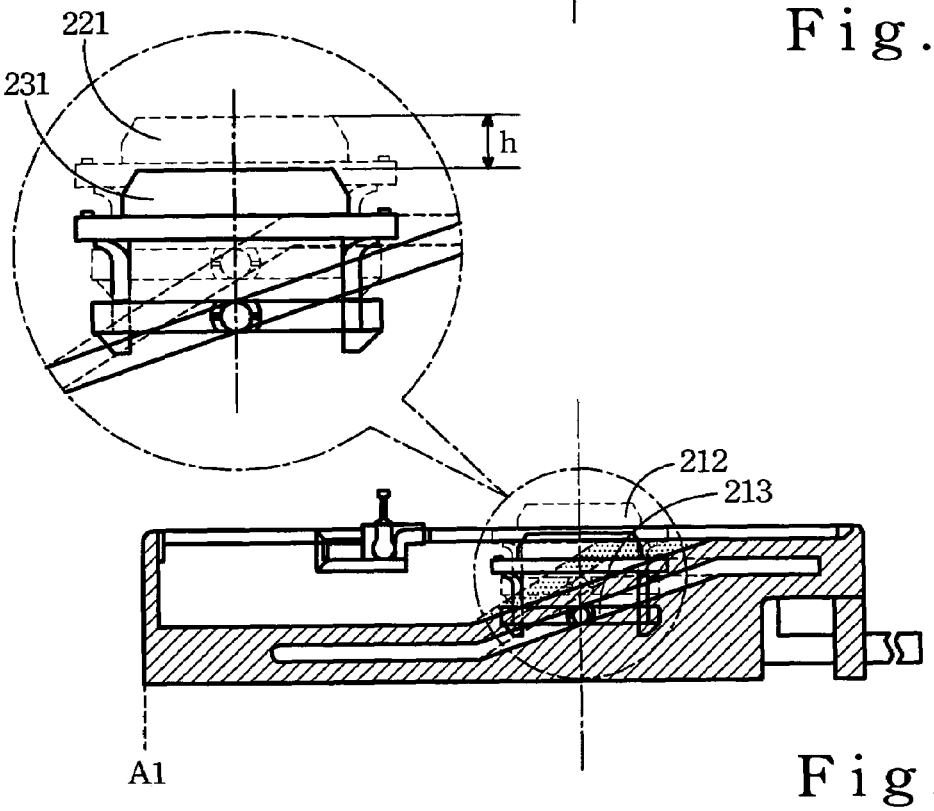
FIG. 5B is a sectional view, illustrating how a shield is moved to a maintenance region in the printer equipped with the print-head maintenance device of the present.

Referring to FIG. 5B, in case the user of the inkjet printer equipped with the maintenance device 22 of the present invention replace the ink cartridges (similar to those used in four-color inkjet printer). The software package of the printer can transmit a signal to the driver system after verifying the type of ink cartridges such that the driver system (stepper motor) will drive the sliding member 21 in a different increment as shown in FIG. 5B. Because, the third inclined guiding grooves 212 have a larger inclination than that of the four inclined guiding grooves 213, the first shield 221 is pushed further upward along the second guiding grooves 202 (see FIG. 4B) for a distance of (h) with respect to the second shield 231 when the sliding member 21 arrives at the position A1. Since the first shield 221 is used for maintenance the triple-color cartridge, the ink within the same is protected. In case, the air pumps are activated at this time, the waste ink from the print-heads of the triple-color cartridge is pumped out efficiently due to hermetical-sealing effect therebetween.

Figure 5C:
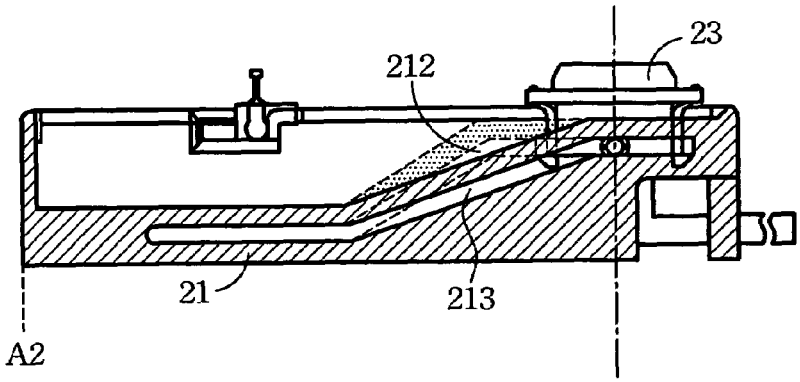
FIG. 5C is a sectional view, illustrating a position where an ink cartridge is maintained by the print-head maintenance device of the present to prevent untimely blocking of the print-head.

Referring to FIG. 5C, in case the user of the inkjet printer equipped with the maintenance device 22 of the present invention replace the ink cartridges (similar to those used in six-color inkjet printer). The software package in the printer can transmit a signal to the driver system after verifying the type of ink cartridges such that the driver system (stepper motor) will drive the sliding member 21 in an exact increment as shown in FIG. 5C. Though the third inclined guiding grooves 212 have a larger inclination than that of the four inclined guiding grooves 213, the first and second shields 221, 231 is pushed simultaneously upward along the second guiding grooves 202 (see FIG. 4B) when the sliding member 21 arrives at the position A2, thereby disposing the first and second shields 221, 231 to be flush with each other for sealingly pressing against the print-heads of two triple-color cartridges. The same elevation of the shields 221, 231 is possible since the third and fourth inclined guides 212,213 have flush straight groove sections. In case, the air pumps are activated at this time, the waste ink from the print-heads of the triple-color cartridge is pumped out efficiently due to hermetical-sealing effect therebetween.

To summarize the above paragraphs, employment of the maintenance device 2 of the present invention in the inkjet printer, the prior drawbacks resulting from the use of the conventional inkjet printer can be overcome. Since the shielding units 22, 23 are arranged to move vertically along the second guiding grooves to press sealingly against the print-head, sidewise wearing of the shields 221, 231 will not occur. Moreover, the longitudinal movement of the ink cartridges can be reduced, hence the entire longitudinal length of the inkjet printer.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A print-head maintenance device for maintaining a print-head of an ink cartridge, the ink cartridge being movable back and forth along a guiding rail, the maintenance device being disposed securely below one end of the guiding rail, the print-head maintenance device comprising:

a casing having a bottom, left and right sides formed with a pair of first guiding grooves extending parallel to said bottom, said casing further being formed with a pair of second guiding grooves that are located inwardly with respect to said pair of first guiding grooves and extend perpendicularly from said bottom of said casing;

a sliding member disposed within said casing, and having left and right outward tongues engaging slidably said pair of first guiding grooves so as to permit two-way movement of said sliding member within said casing, said sliding member further having a pair of inclined third guiding grooves formed on two opposite inner surfaces; and a shielding unit including a mounting seat disposed within said casing and having front and rear positioning stubs respectively engaging said pair of second guiding grooves in said casing, and two flanges on left and right lateral sides for engaging with said pair of third guiding grooves in said sliding member, and a shield fixed on said mounting seat;

whereby, movement of said sliding member along said pair of first guiding grooves in a first direction results in pushing of said mounting seat by said sliding member, thereby moving said mounting seat along said pair of second guiding groove so as to press said shield against the print-head, and movement of said sliding member along said pair of first guiding grooves in a second direction opposite to said first direction results in removal of said shield from the print-head.

2. The print-head maintenance device according to claim 1, further comprising a wiper fixed on said sliding member in such a manner that said wiper is adapted to wipe the print-head when said sliding member moves along said pair of first guiding grooves in said first direction so as to pass below the print-head.

3. The print-head maintenance device according to claim 2, further comprising a cleaning structure extending from said casing and disposed midway of said pair of first guiding grooves so as to make contact with said wiper by virtue of relative movement therebetween when said wiper moves together with said sliding member along said pair of first guiding grooves in said first direction.

4. The print-head maintenance device according to claim 1, further comprising a driving member for moving said sliding member along said pair first guiding grooves in said casing.

5. The print-head maintenance device according to claim 4, wherein said driving member includes a stepper motor, said sliding member having a rack extending outward for engaging with said stepper motor such that actuation of said stepper motor results in movement of said sliding member along said pair first guiding grooves in said casing.

6. The print-head maintenance device according to claim 4, wherein said driving member includes a stepper motor and a gear system, said sliding member having a rack extending outward for engaging with said stepper motor via said gear system such that actuation of said stepper motor results in movement of said sliding member along said pair of first guiding grooves in said casing.

7. A maintenance device for maintaining two print-heads of a pair of ink cartridges that are juxtaposed to each other, wherein the ink cartridges are movable back and forth along a guiding rail and the maintenance device is disposed securely below one end of the guiding rail, the maintenance comprising:

a casing having a bottom, and left and right sides formed with a pair of first guiding grooves extending parallel to of said bottom, said casing further being formed with a pair of second guiding grooves that are located inwardly with respect to said pair of first guiding grooves and extend perpendicularly from said bottom of said casing;

a sliding member disposed within said casing, and having left and right outward tongues engaging slidably said pair of first guiding grooves in said casing so as to permit two-way movement of said sliding member within said casing, said sliding member having a pair of inclined third guiding grooves and a pair of inclined fourth guiding grooves;

a first shielding unit including a first mounting seat that has front and rear positioning stubs respectively engaging said pair of second guiding grooves in said casing, and two flanges on left and right lateral sides for engaging said pair of inclined third guiding grooves in said sliding member, and a first shield fixed on said first mounting seat; and a second shielding unit including a second mounting seat that has front and rear positioning stubs respectively engaging said pair of second guiding grooves in said casing, and two flanges on left and right lateral sides for engaging said pair of inclined fourth guiding grooves in said sliding member, and a second shield fixed on said second mounting seat;

whereby, movement of said sliding member along said pair of first guiding grooves in a first direction results in simultaneous pushing of said first and second mounting seats by said sliding member, thereby moving said first and second mounting seats along said pair second guiding grooves so as to press said first and second shields respectively against the print heads, and movement of said sliding member along said pair of first guiding grooves in a second direction opposite to said first direction results in removal of said first and second shields respectively from said print-heads.

8. The maintenance device according to claim 7, wherein said pair of inclined third guiding grooves has an inclination different from that of said pair of inclined fourth guiding grooves.

9. The maintenance device according to claim 7, further comprising first and second wipers fixed on said sliding member in such a manner said first and second wipers are adapted to wipe the print-heads respectively when said sliding member moves along said pair of first guiding grooves in said first direction so as to pass below the print-heads.

10. The maintenance device according to claim 9, further comprising first and second cleaning structures extending from said casing, and disposed midway of said pair of first guiding grooves so as to make contact with said first and second wipers by virtue of relative movement therebetween when said first and second wipers move together with said sliding member along said pair of first guiding grooves in said first direction.

11. The maintenance device according to claim 7, further comprising a driving member for moving said sliding member along said pair first guiding grooves in said casing.

12. The maintenance device according to claim 11, wherein said driving member includes a stepper motor, said sliding member having a rack extending outward for engaging with said stepper motor such that actuation of said stepper motor results in movement of said sliding member along said pair first guiding grooves in said casing.

13. The maintenance device according to claim 11, wherein said driving member includes a stepper motor and a gear system, said sliding member having a rack extending outward for engaging with said stepper motor via said gear system such that actuation of said stepper motor results in movement of said sliding member along said pair of first guiding grooves in said casing.

* * * * *